United States Patent [19]

Nordberg et al.

[11] 4,074,219

[45] Feb. 14, 1978

[54] MOUNTING MEANS FOR A CIRCUIT BREAKER

[75] Inventors: Svein T. Nordberg; Donald R. Shaner, both of El Paso, Tex.

[73] Assignee: GTE Sylvania Incorporated, Stamford, Conn.

[21] Appl. No.: 669,999

[22] Filed: Mar. 24, 1976

[51] Int. Cl.[2] ..... H01H 85/02

[52] U.S. Cl. ..... 337/186; 337/209; 337/213; 337/246

[58] Field of Search ..... 337/186, 201, 207, 209, 337/213, 214, 215, 246, 247

[56] References Cited

U.S. PATENT DOCUMENTS

| | | | |
|---|---|---|---|
| 3,246,106 | 4/1966 | Sommers | 337/209 |
| 3,471,817 | 10/1969 | Marechal | 337/201 |

*Primary Examiner*—Robert J. Hickey
*Attorney, Agent, or Firm*—Norman J. O'Malley; Theodore D. Lindgren; Robert T. Orner

[57] ABSTRACT

A mount for a circuit breaker for mounting the circuit breaker in a holder of the type typically used for fuses and a method of making the mount is disclosed. Engaging means such as metallic screw threads or a bayonet ferrule are bonded to the envelope of the circuit breaker with one of the circuit breaker leads attached thereto. The other circuit breaker lead is attached to an eyelet. A spacer is molded between the base of the circuit breaker and the eyelet to hold the eyelet in a fixed position relative to the circuit breaker so that when the screw threads or bayonet ferrule is engaged with a holder, the eyelet contacts a contact in the base of the holder.

10 Claims, 8 Drawing Figures

MOUNTING MEANS FOR A CIRCUIT BREAKER

FIELD OF THE INVENTION

This invention relates to molded mounting means and more particularly to means for mounting a circuit breaker in a holder.

BACKGROUND OF THE INVENTION

Electrical equipment is typically protected from overloads or over-voltages by fuses or circuit breakers which disconnect the equipment from a power source when an overload or over-voltage condition occurs. Fuses are often preferred for this purpose because of their low cost. Fuses, however, suffer from the disadvantage of requiring replacement. Hence, fuses are typically contained in a holder designed to facilitate easy replacement. The holder typically includes a holder or base portion electrically connected in series between the power source and the equipment being protected. The fuse is placed in the holder and a cap is attached by suitable screw threads or a bayonet engagement to hold the fuse in the holder and to complete the electrical circuit.

Circuit breakers have the advantage of not requiring replacement. Typical circuit breakers can be either self-resetting or manually resetable. With either type the circuit breaker is ordinarily soldered in place because replacement is normally not required in typical use.

An example of electrical equipment which makes extensive use of fuses or circuit breakers is the various amplifier stations in a community antenna television (CATV) signal distribution system. A typical amplifier station is shown in Lieberman et al., U.S. Pat. No. 3,717,813 wherein various input/output lines and the power supply are fused. CATV systems are subject to various overload conditions such as power line surges, short circuits, lightening induced surges, and the like. Such overload conditions can burn out a substantial number of fuses particularly where the surge travels from one amplifier station to other amplifier stations. Replacement of a large number of fuses is time consuming and expensive because the particular amplifier stations with burned out fuses must be located and individually accessed.

The use of circuit breakers in such systems is highly advantageous because replacement is not ordinarily required. Self-resetting or cycling circuit breakers provide a further advantage where the overload condition is due to a momentary power or voltage surge or short circuit. Many users desire fuses, however, because of their low cost and many CATV systems have equipment presently using fuses.

To provide flexibility for manufacturers, it is desirable to provide equipment which can accomodate either fuses or circuit breakers as the customer desires. Furthermore, owners of existing equipment often desire retrofitting their existing equipment with circuit breakers. In order to expeditiously accomodate such options, it is known in the prior art to modify fuse holder caps to accomodate circuit breakers. One such known modification includes drilling a hole through the top of the fuse holder cap to allow the longer circuit breaker to extend through the cap, bonding the cap to a circuit breaker envelope, soldering the circuit breaker lead to the fuse holder cap, and providing a spacer between the base of the fuse holder and the circuit breaker. All of this modification requires substantial effort resulting in costly and time consuming construction. Furthermore, the complexity of manufacture results in substantial scrap and the assemblage of miscellaneous parts results in low reliability.

OBJECTS OF THE INVENTION

Accordingly, it is a primary object of this invention to obviate the above noted and other disadvantages of the prior art.

It is a further object of this invention to provide mounting structure for mounting a circuit breaker in a holder.

It is a further object of this invention to provide inexpensive and reliable mounting structure for mounting a circuit breaker in a holder.

It is a further object of this invention to provide a method for manufacturing mounting structure for mounting a circuit breaker in a holder.

It is a further object of this invention to provide an efficient, inexpensive, and reliable method for manufacturing mounting structure for mounting a circuit breaker in a holder.

SUMMARY OF THE INVENTION

The above and other objects and advantages are achieved in one aspect of this invention by mounting means for mounting a circuit breaker having an envelope with a pair of electrical conductors extending from a base of the envelope in a holder having an electrically insulative body with a conductive first contact carried by the base of the body and a conductive first retaining means carried by the body. The mounting means includes conductive second retaining means, a conductive second contact, and electrically insulative spacing means. The conductive second retaining means is fixedly attached to the envelope of the circuit breaker for engaging the first retaining means to retain the circuit breaker in the holder. Means electrically connect one of the pair of electrical conductors to the second retaining means. The conductive second contact is electrically connected to the other one of the pair of electrical conductors. The electrically insulative spacing means is molded between the base of the envelope and the second contact for fixedly spacing the second retaining means from the second contact a predetermined distance to insure contact between the first and second contacts when the first and second retaining means are engaged.

The above and other objects and advantages are achieved in another aspect of this invention by a method of forming a mount for mounting a circuit breaker having an envelope with a pair of electrical conductors extending from a base of the envelope in a holder having an electrically insulative body with a conductive first contact carried by the base of the body and a conductive first retaining means carried by the body. This method includes the steps of bonding a conductive second retaining means to the envelope, attaching the pair of electrical conductors, and molding an electrically insulative spacing material. The second retaining means is bonded to the envelope in a position circumscribing at least a portion of the envelope for engaging the first retaining means to retain the circuit breaker in the holder. One of the pair of electrical conductors is attached to the second retaining means for forming an electrical connection therebetween. A conductive second contact is attached to the other one of the pair of electrical conductors. The electrically insulative spacing material is molded between the base of the envelope of the circuit breaker and the second contact for spacing the second retaining means from the second contact a predetermined distance. The predetermined distance ensures contact between the first and second contacts when the first and second retaining means are engaged. The spacing material encompasses the pair of conductors for holding the conductors in a spaced relationship.

DETAILED DESCRIPTION OF THE PREFERRED EMBODIMENTS

For a better understanding of the present invention, together with other and further objects, advantages and capabilities thereof, reference is made to the following disclosure in conjunction with the accompanying drawings.

Figure 1:
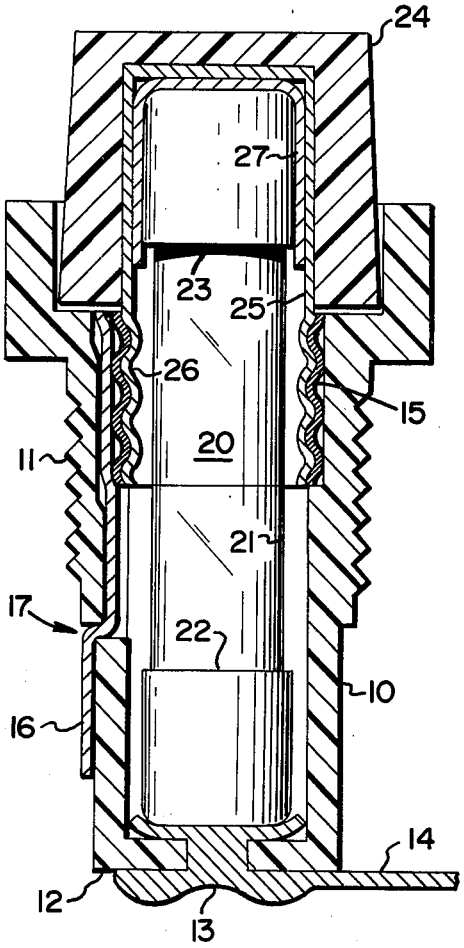
Fig. 1 PRIOR ART
FIG. 1 is a sectional view of a prior art fuse holder with a fuse and fuse holder cap assembled therewith.

FIG. 1 is a sectional view of a typical fuse holder with a fuse mounted therein. The holder includes an electrically insulative body 10 adapted to be attached to the chassis of electrical equipment such as a CATV amplifier station. For example, the holder may be attached by screw threads 11 molded into the holder body 10. The holder further has a base 12 which carries a conductive contact 13. Electrical connection to the fuse can be made by soldering an electrical conductor to a strap 14 attached to contact 13. Body 10 further carries a retaining means illustrated as a metallic cylinder 15 with screw threads formed in the wall thereof. A strap 16 runs along the side of body 10 with one end electrically attached to screw threads 15 and the other end extending through an opening 17 in body 10 for attachment to an electrical conductor.

Body 10 is generally cylindrical for receiving a fuse 20 therein. Fuse 20 has an envelope 21 which is normally transparent so that the condition of the fuse can be visually observed. A metallic end cap 22 on one end of fuse 20 contacts electrical contact 13. Fuse 20 has a second metallic end cap 23 on the other end thereof.

An electrically insulative fuse holder cap 24 has a generally cylindrical metallic insert 25 therein. Insert 25 terminates in screw threads 26 which are adapted to engage screw threads 15. A metallic spring 27 inside of insert 25 assures good electrical contact between end cap 23 and insert 25.

Accordingly, a continuous electrical path is established from contact 13 via fuse 20, spring 27, insert 25, screw threads 26, and screw threads 15 to strap 16. Overload or over-voltage conditions destroy the fuse element of fuse 20 thereby requiring removal of cap 24, visual inspection of fuse 20, and replacement if the fuse element has been destroyed. A power or voltage surge may destroy numerous fuses in systems such as CATV systems necessitating time consuming and laborious visual inspection of a large number of fuses to determine which ones require replacement.

To circumvent this problem circuit breakers may be substituted for the fuse holder and fuse 20, for example, by soldering the circuit breaker leads to the electrical conductors which would otherwise be attached to straps 14 and 16. Cycling or self-resetting circuit breakers are preferred because they will automatically reestablish electrical continuity if the over-voltage or overload condition disappears.

As was indicated above, however, users may still desire fuses and, in the interest of commonality during manufacture, it is highly desirable to provide structure capable of accepting either fuses or circuit breakers with minimal manufacturing changes. Also, retrofitting existing equipment often requires an undue amount of effort and expense to remove the fuse and holder and to replace them with a circuit breaker.

Figure 2:
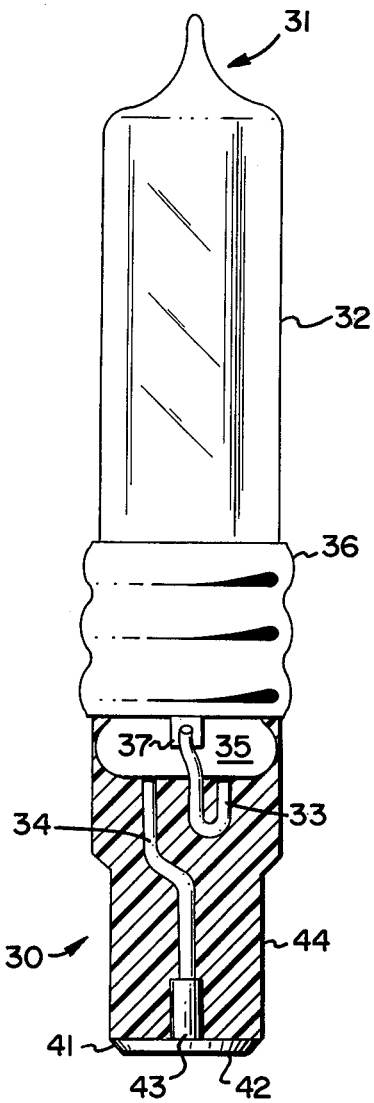
FIG. 2 is a front view, partially in section of one embodiment of mounting means in accordance with the invention.

A preferred embodiment of the invention is illustrated in FIG. 2 wherein mounting means 30 adapts circuit breaker 31 for mounting directly in fuse holder body 10. Circuit breaker 31 has an envelope 32 with a pair of electrical conductors 33 and 34 extending from a base 35 of envelope 32.

A conductive retaining means illustrated as a generally metallic cylinder 36 with screw threads formed in the wall thereof is fixedly attached or bonded to envelope 32. Screw threads 36 can be any suitable conductive metal such as brass or steel. The bonding step can be performed by any suitable metal-to-glass adhesive or glue when envelope 32 is glass. If an alternate material is used for envelope 32, an alternative bonding component may be desired. Conductor 33 of circuit breaker 31 is electrically connected to screw threads 36 by suitable means such as by soldering to a tab 37 depending from the lower edge of screw threads 36. Alternatively, lead 33 can be attached directly to screw threads 36, for example, on the inner surface thereof.

Figure 3:
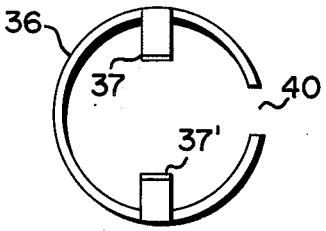
FIG. 3 is a bottom view of the retaining means of FIG. 2.

FIG. 3 is a bottom view of screw threads 36 wherein tab 37 is illustrated as being bent inward to provide clearance when screw threads 36 are mated with screw threads 15 of holder body 10. Those skilled in the art will realize that alternate attaching means can be provided for screw threads 36 and conductor 33. An alternative tab 37' also can be provided to provide flexibility during manufacture. Screw threads 36 circumscribe at least a portion of envelope 32, however, a gap 40 is provided therein to provide tolerance for varying diameters of envelope 32.

A conductive contact 41 illustrated as an eyelet with a planar surface 42 and a sleeve 43 is electrically connected to conductor 34. The connection can be made, for example, by inserting and soldering lead 34 in sleeve 43. The structure is completed by molding electrically insulative spacing means 44 between base 35 of envelope 32 and contact 41. Molded spacer 44, shown in section in FIG. 2, fixedly spaces base 35 and screw threads 36 from contact 41 by predetermined distance to insure good electrical contact between contact 41 and contact 13 (of FIG. 1) when screw threads 36 are engaged with screw threads 15.

Any suitable molding structure and molding material or compound can be used to form spacer 44. A non-conductive molding compound such as a silicone compound is presently preferred. The molding compound preferably should not expand when it is removed from the mold but it is preferably compressible or resilient to provide good electrical contact between contacts 13 and 41 and between screw threads 15 and 36. A suitable molding compound is a silicone potting compound sold under the trademark RTV-60 of the General Electric Company.

Spacer 44 also encompasses conductors 33 and 34 to hold the conductors in a spaced relationship so that they do not short together. Also, the dimensions of spacer 44 are controlled so that good electrical contacts are made. The dimensions of spacer 44, however, can be readily varied to accomodate different fuse holder designs.

Figure 4:
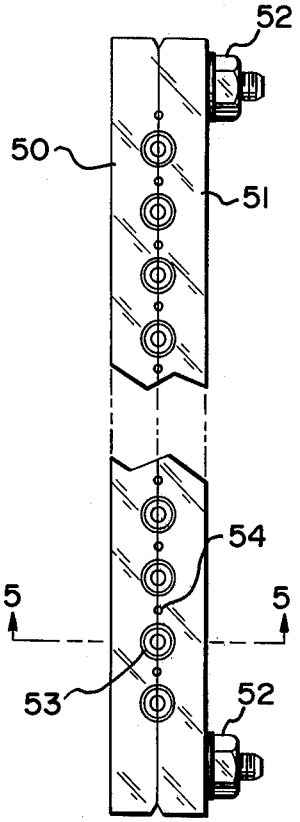
FIG. 4 is a top view of a mold useful in practicing the invention.

A suitable mold structure for manufacturing the mounting means of FIG. 2 is illustrated in FIG. 4. The mold of FIG. 4 includes two elongated halves 50 and 51 with a plurality of cavities distributed along the junction plane of halves 50 and 51. Suitable fasteners 52 maintain the mold in assembled form. Each cavity has an injection port associated therewith. For example, cavity 53 has an injection port 54 which provides access to the mold cavity when the circuit breaker is positioned in the upper portion of the cavity.

Figure 5:
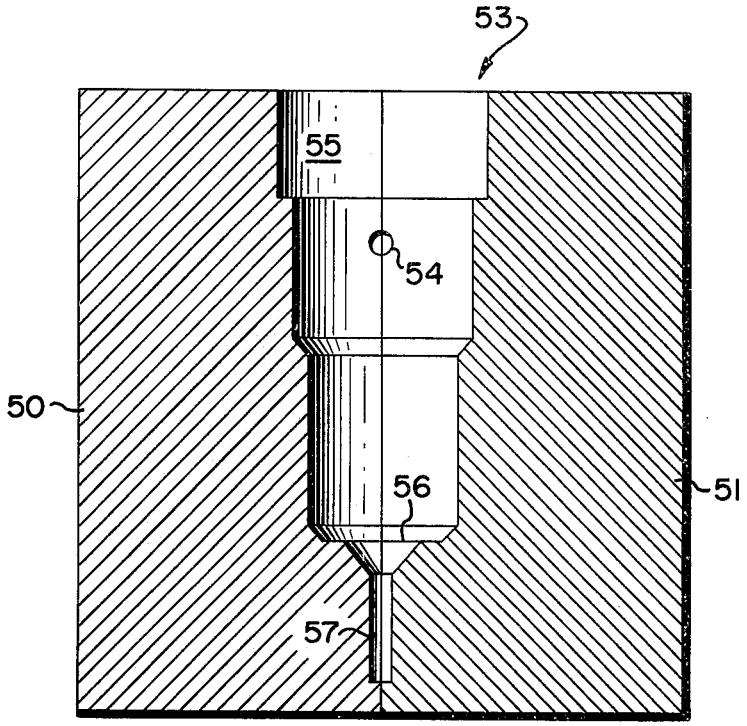
FIG. 5 is an enlarged sectional view taken through one mold cavity along line 5—5 of FIG. 4.

FIG. 5 is a sectional view of the mold structure taken along line 5—5 through cavity 53. In assembling the circuit breaker and mount of FIG. 2, screw threads 36 are first bonded to the circuit breaker envelope 32. Lead 33 is then attached to tab 37 and lead 34 is attached to eyelet 41. Then the assembly is placed in cavity 53 such that screw threads 36 enter the upper portion 55 of cavity 53. Eyelet 41 is positioned in the lower portion of the cavity against surface 56. Lead 34 can extend through eyelet 41 into an alignment guide 57 below surface 56. This excess portion of lead 34 is removed subsequent to the molding step. After the assembly is properly positioned in cavity 53, the molding compound is injected through port 54 to fill the remaining portion of cavity 53 to form spacer 44. Note that injection port 54 is along the junction plane of mold halves 50 and 51 to facilitate cleaning.

Figure 6:
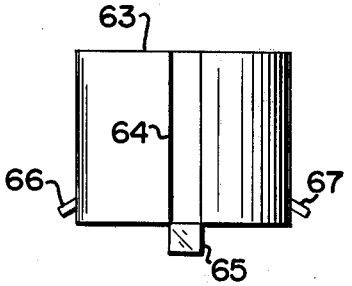
FIG. 6 is a front view of a bayonet ferrule in accordance with a second embodiment of the invention.
Figure 7:
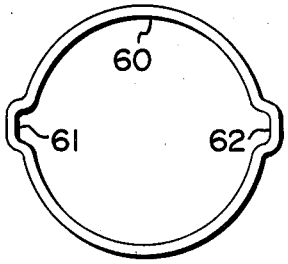
FIG. 7 is a top view of a bayonet holder in accordance with the second embodiment.
Figure 8:
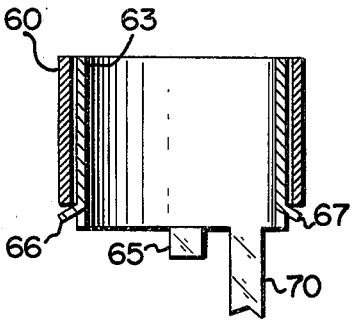
FIG. 8 is a sectional view of the bayonet ferrule and bayonet holder assembled.

FIGS. 6, 7, and 8 illustrate a bayonet engagement which can be used in place of screw threads 15 and 36. Such bayonet engagements are commonly used in fuse holders. Accordingly, when existing equipment is being retrofitted with circuit breakers, it is desirable to have mounts for the circuit breakers which can be utilized with bayonet holders.

A bayonet holder 60 of FIG. 7 is used in place of screw threads 15 in a fuse holder. Holder 60 has channels 61 and 62 on opposite sides thereof for receiving bayonet lugs. Slots near or on the bottom surface of holder 60 communicate with channels 61 and 62 in the usual manner. In practice one of channels 61 and 62 can be, and is often, formed by a gap in holder 60.

A bayonet ferrule or clip 63 is illustrated in FIG. 6. Ferrule 62 replaces screw threads 36 of FIG. 2 when a circuit breaker with a bayonet engagement is desired. Ferrule 63 has a slot 64 similar to, and for the same purpose as, slot 40 in screw threads 36. Ferrule 63 also has a tab 65 similar to tab 37 of screw threads 36. Bayonet lugs 66 and 67 are received by channels 61 and 62. When ferrule 63 is fully inserted into holder 60 and rotated, lugs 66 and 67 engage the slots at the lower surface of holder 60 as is shown in the sectional view of FIG. 8. A strap 70 formed with and depending from the lower edge of holder 60 is equivalent to strap 16 of FIG. 1.

In forming a mounting means for a bayonet engagement, ferrule 63 replaces screw threads 36 in the process. Typical fuse holders with bayonet engagements may include a two piece contact 13 (FIG. 1) with a spring between the two pieces to allow the bayonet engagement to be under tension. Alternatively, spacer 44 may be formed of a molding compound with sufficient resiliency so that a spring contact is unnecessary. Here again, RTV-60 silicone potting compound performs satisfactorily.

Accordingly, various embodiments of mounting means in accordance with the invention have been illustrated and described. Mounting means in accordance with the invention can be manufactured efficiently, inexpensively, and reliably to provide resulting structure which is reliable and inexpensive and can be used to easily replace fuses with circuit breakers.

While there has been shown and described what is at present considered the preferred embodiments of the invention it will be obvious to those skilled in the art that various changes and modifications may be made therein without departing from the invention as defined by the appended claims.

We claim as our invention:

1. Mounting means for mounting a circuit breaker having an envelope with a pair of electrical conductors extending from a base of said envelope in a holder having an electrically insulative body with a conductive first contact carried by the base of said body and a conductive first retaining means carried by said body comprising:

conductive second retaining means circumscribing at least a portion of said envelope and bonded thereto for engaging said first retaining means to retain said circuit breaker in said holder;

means for electrically connecting one of said pair of electrical conductors to said second retaining means;

a conductive second contact electrically connected to the other one of said pair of electrical conductors; and electrically insulative spacing means molded between said base of said envelope and said second contact for fixedly spacing said second retaining means from said second contact a predetermined distance, said spacing means encompassing said pair of conductors for holding said conductors in a spaced relationship, said predetermined distance ensuring contact between said first and second contacts when said first and second retaining means are engaged.

2. Mounting means as defined in claim 1 wherein said means for electrically connecting includes a tab on said second retaining means and said one of said pair of electrical conductors is attached to said tab.

3. Mounting means as defined in claim 1 wherein said second contact is an eyelet with a planar surface for contacting said first contact and a sleeve for receiving said other one of said pair of electrical conductors.

4. Mounting means as defined in claim 1 wherein said first and second retaining means each include a metallic cylinder with screw threads formed in the wall thereof.

5. Mounting means as defined in claim 1 wherein said first and second retaining means include a bayonet engagement.

6. Mounting means for mounting a circuit breaker having an envelope with a pair of electrical conductors extending from a base of said envelope in a holder having an electrically insulative body with a conductive first contact carried by the base of said body and a conductive first retaining means carried by said body comprising:

conductive second retaining means fixedly attached to said envelope for engaging said first retaining means to retain said circuit breaker in said holder;

means for electrically connecting one of said pair of electrical conductors to said second retaining means;

a conductive second contact electrically connected to the other one of said pair of electrical conductors; and electrically insulative spacing means molded between said base of said envelope and said second contact for fixedly spacing said second retaining means from said second contact a predetermined distance to ensure contact between said first and second contacts when said first and second retaining means are engaged.

7. Mounting means as defined in claim 6 wherein said means for electrically connecting includes a tab on said second retaining means and said one of said pair of electrical conductors is attached to said tab.

8. Mounting means as defined in claim 6 wherein said second contact is an eyelet with a planar surface for contacting said first contact and a sleeve for receiving said other one of said pair of electrical conductors.

9. Mounting means as defined in claim 6 wherein said first and second retaining means each include a metallic cylinder with screw threads formed in the wall thereof and said second retaining means circumscribes at least a portion of said envelope and is bonded thereto.

10. Mounting means as defined in claim 6 wherein said first and second retaining means include a bayonet engagement and said second retaining means circumscribes at least a portion of said envelope and is bonded thereto.

* * * * *